US007093642B2

(12) United States Patent
Sharp et al.

(10) Patent No.: US 7,093,642 B2
(45) Date of Patent: Aug. 22, 2006

(54) SYSTEMS AND METHODS FOR A ROBOTIC TAPE APPLICATOR

(75) Inventors: Terrance M. Sharp, Milton (CA); Steven K. Frendle, Kearney, MO (US); Dan B. Jordan, Liberty, MO (US); Kevin M. Campbell, Hartland, MI (US); Robert J. Orscheln, Liberty, MO (US); Ted McMillin, Liberty, MO (US)

(73) Assignee: Henkel Corporation, Gulph Mills, PA (US)

( * ) Notice: Subject to any disclaimer, the term of this patent is extended or adjusted under 35 U.S.C. 154(b) by 0 days.

(21) Appl. No.: 10/991,853

(22) Filed: Nov. 19, 2004

(65) Prior Publication Data

US 2005/0161161 A1 Jul. 28, 2005

Related U.S. Application Data

(63) Continuation-in-part of application No. 10/087,930, filed on Mar. 5, 2002, and a continuation-in-part of application No. 10/826,506, filed on Apr. 19, 2004.

(60) Provisional application No. 60/523,483, filed on Nov. 19, 2003, provisional application No. 60/535,968, filed on Jan. 12, 2004, provisional application No. 60/623,066, filed on Oct. 29, 2004.

(51) Int. Cl.
*B29C 65/00* (2006.01)

(52) U.S. Cl. ..... 156/574; 156/361; 156/523

(58) Field of Classification Search ..... 156/199, 156/264, 281, 361, 459, 517, 522, 523, 524, 156/540, 574, 575, 577, 578
See application file for complete search history.

(56) References Cited

U.S. PATENT DOCUMENTS

| | | | | | |
|---|---|---|---|---|---|
| 4,382,836 | A | * | 5/1983 | Frank | 156/459 |
| 4,591,402 | A | * | 5/1986 | Evans et al. | 156/350 |
| 4,720,320 | A | * | 1/1988 | Niemi | 156/504 |
| 4,792,860 | A | * | 12/1988 | Kuehrle | 358/300 |
| 4,813,540 | A | * | 3/1989 | Barnell et al. | 206/400 |
| 5,072,359 | A | * | 12/1991 | Kneifel, II | 700/123 |
| 5,127,981 | A | * | 7/1992 | Straub et al. | 156/519 |
| 5,518,576 | A | * | 5/1996 | Mendelovich et al. | 156/523 |
| 5,536,342 | A | | 7/1996 | Reis et al. | 156/64 |
| 5,700,347 | A | * | 12/1997 | McCowin | 156/425 |
| 5,779,830 | A | | 7/1998 | Wakefield et al. | 156/64 |

OTHER PUBLICATIONS

Publication from Concinnati Milacron titled "Into the Future" published 1988.*

* cited by examiner

*Primary Examiner*—Jeff H. Aftergut
*Assistant Examiner*—John L. Goff
(74) *Attorney, Agent, or Firm*—Thomas A. Corrado; Kilpatrick Stockton LLP

(57) ABSTRACT

The present invention is directed to systems and methods for automatically applying a tape, such as an adhesive, to a work-piece. According to one embodiment of the present invention, there is provided a system and method for a robotic tape applicator that includes a computer apparatus, a tape applicator apparatus, and an apparatus for holding a work-piece in registration with the tape applicator apparatus for tape application in response to programming data from the computer apparatus. Other components, such as a tape cutting apparatus, a splicing apparatus, adhesion promoter apparatus, and/or optical system can be added to assist and enhance the tape application process.

21 Claims, 14 Drawing Sheets

SYSTEMS AND METHODS FOR A ROBOTIC TAPE APPLICATOR

PRIORITY

This application is a continuation-in-part (CIP) of the following U.S. Utility patent applications:

1. Ser. No. 10/087,930, filed Mar. 5, 2002, entitled, "ROBOTIC TAPE APPLICATOR AND METHOD;" and
2. Ser. No. 10/826,506, filed Apr. 19, 2004, entitled, "ROBOTIC TAPE APPLICATOR AND METHOD."

The aforementioned utility patent applications are herein incorporated by reference in their entireties.

This application claims priority to the following U.S. Utility and Provisional Patent Application:

1. No. 60/523,483, filed Nov. 19, 2003, entitled, "ROBOTIC TAPE APPLICATOR AND METHOD FOR APPLYING TAPE;"
2. No. 60/535,968, filed Jan. 12, 2004, entitled, "ROBOTIC TAPE APPLICATOR AND METHOD FOR APPLYING TAPE;" and
3. No. 60/623,066, filed Oct. 29, 2004, entitled, "SYSTEMS AND METHODS FOR ROBOTIC TAPE APPLICATOR." (Attorney Docket No. FDH0006-PRO).

The aforementioned utility and provisional patent applications are herein incorporated by reference in their entireties.

BACKGROUND OF THE INVENTION

1. Field of the Invention

This invention relates to the field of sealing, adhesives, and applying structural enhancements. Particularly, the invention relates to the field of applying a tape onto a work-piece by using a robot.

2. Background

It is known in the art to employ mastics, foams and expandable materials for sealing cavities and joints between metal, glass, plastic, composites, combinations of these components. Examples of metal components include metal panels such as those used in metal buildings, roofing, pipelines, aircraft, medical instruments, marine, non-automotive equipment and vehicles such as tractors, tractor trailers, golf cars, construction equipment, recreational vehicles, etc, and automotive components, among other applications wherein robot assembly is desirable. In the case of automotive components, metal is typically stamped into a desired configuration and the joint between the stamped metal components, or over/under the metal seam, is sealed (e.g., to control wind, dust, noise, water intrusion, metal bonding, structural reinforcement, and function as an adhesion promoter).

In a typical manufacturing operation, a worker seals, (including adding an adhesive, or a structural material or sound abatement material) a work-piece (e.g., stamped metal part or component), by applying a tape onto the metal component. The worker is required to maneuver a tape (e.g., a sealant) along a non-linear path, and to apply sufficient pressure to the tape in order for the tape to adhere to the underlying metal component (e.g., stamped automotive part). The metal component can also have contours that complicates such tape application. This requires a significant amount of manual dexterity on the part of the worker at various stages, laying down the tape and applying appropriate pressure to the tape in order to ensure that the tape will be fastened securely and function adequately.

Accordingly, it would be desirable to reduce the time required to perform these taping operations while retaining, or improving the level of precision of a skilled worker. In addition, it would be an advantage to provide a method of applying tape that is uniform, predictable and reproducible, using an apparatus which is cost-effective.

U.S. patent application Ser. No. 10/087,930, filed Mar. 5, 2002, discloses an applicator and method for applying two-sided adhesive tape between two plastic components; the disclosure of which is hereby incorporated by reference in its entirety.

SUMMARY OF THE INVENTION

Broadly, the invention relates to systems and methods for applying a tape and sealing with the tape. In one embodiment, the system includes a robotically controlled tape applicator, and a computerized method or process for applying the tape that includes placing the part to be sealed into a specified orientation in relation to a robotically controlled tape applicator and applying tape along a surface of the part to be sealed. The computerized method includes using the robotically controlled tape applicator to apply the tape along a predetermined path, and using computer control for operating the tape applicator and monitoring the tape.

As referred herein, a "tape" can be an adhesive, a sealant, sound abatement material, among other adhesive materials. Also, a tape can be adhesive or tacky on both sides or is capable of being rendered adhesive or tacky on both sides. Tapes can be used in automotive, industrial, among other applications. Tapes suitable for robotic application can have a wide range of chemical compositions and physical properties. Examples of suitable tapes used in automotive sealing include tapes that can be welded through and seal the welded area, tapes with mastic and a thin film (e.g., EPDM, butyl, nitrile, SBR, polybutadiene, metallic filler); tapes having a weld through film only (e.g., EMA, ethylene acrylic, epoxy); tapes having a rigid or structural film (e.g., epoxy or ethylene acrylic); tapes that are heat cured subsequent to application and become rigid or function as structural reinforcements (e.g., nitrile, ethylene acrylic, epoxy, and SBR); tapes having various degrees of temperature resistance (e.g., high temperature resistant compounds such as fluoroelastomer, polysiloxane, ethylene arylic, EPDM, and acrylic and ambient to medium resistant compounds such as butyl, polybutadiene, SPR, nitrile, neoprene and low temperature compounds such as flouro, polysiloxane); heat expandable compositions, paintable sealants, tapes that melt when heated, among other tapes used for automotive applications. Automotive tapes are available from Orbseal LLC of Richmond, Mo.

The tape can also include a general purpose material such as PVC, Mylar®, polyethylene, or similar backings on pressure sensitive mastic, that can used for barrier wrap. An example of such a material includes the laminar structure disclosed in U.S. Pat. No. 6,638,590B2; the disclosure of which is hereby incorporated by reference in its entirety. The suitable tape (including its backing material) will depend upon the end use of the tape. Examples of suitable backing material includes at least one member selected from the group consisting of polypropylene film, metallic films, glass weave, Kevlar®, Mylar®, or specially formulated films of fluoroelastomer. Tapes could also include special fillers in order to obtain certain desirable properties. Examples of suitable fillers include at least one member selected from the group of metallic (e.g., magnetic), paintable, ceramic, silicates (e.g., corrosion buffer), conductive graphite, expansion agents (e.g., an encapsulated blowing agent), UV cured or activated, among others.

The part, component, member, or work piece to be sealed or taped can have a virtually unlimited configuration and size. Examples of automotive work-pieces onto which tape can be applied by the inventive method include:

Quarter panel seams/joints/panel;
Dash panel seams/joints/panels;
Cowl panel seams/joints/panels;
A post seams/joints;
B post seams/joints;
C post seams/joints;
D/E post seams/joints;
Rocker or sill seams/joints;
Wheel arch seams/joints;
Fuel filler bowl seams/joints;
Rifle arm or shotgun rail seam/joints/panels;
Drain channel seam/joints;
Package tray seams/joints/panels;
Rood ditch seams/joints;
Body side to quarter panel seams/joints/panels;
Lower panel reinforcement seams/joints/panels;
Plenum chamber seams/joints;
Roof header and bow seams/joints/panels;
Hood and rear deck seams/joints/panels;
Floor pan seams/joints/panels;
Light can seams/joints;
Door intrusion beams/joints/panels.

While the size of the automotive components listed above typically ranged from about 100 to 1,400 mm, the size of automotive components (as well as non-automotive components) to be sealed can range widely depending upon the size of the assembled article.

According to one embodiment of the present invention, there is provided a robotic tape applicator that includes a computer apparatus, tape applicator apparatus under the control of the computer apparatus, and a mechanism to hold a work-piece (or part to be sealed) in registration with a tape applicator apparatus such that when the computer apparatus is programmed with data respecting the shape of the work-piece and the proposed path of the tape to be adhered to the work-piece, the tape applicator apparatus is adapted to apply the tape to the work-piece along the path.

According to another embodiment of the present invention, the tape applicator apparatus includes a tape applicator head, cutting apparatus to slice the tape, and tape braking apparatus adapted to hold the tape stationary during cutting.

According to still another embodiment of the present invention, a robotic tape applicator includes a computer adapted to control a robotic arm according to a program, and the robotic arm includes a roller adapted to releasable store tape, guide apparatus to guide the tape to a tape applicator head for application to a work-piece, the tape applicator head including a nose biased to permit reciprocal motion in a direction normal to the work-piece, and cutting apparatus integral with the tape applicator head adapted to cut the tape under the control of the computer. The cutting apparatus can include any suitable mechanism such as a knife blade, rotary cutting die, among other cutting devices.

According to still another embodiment of the present invention, the tape applicator further includes tensioning apparatus located between the roller and the nose adapted to maintain a uniform tension on the tape during tape application.

According to still another embodiment of the present invention, the tape applicator further includes braking apparatus adapted to releasably restrain movement of the tape.

According to still another embodiment of the present invention, the braking apparatus includes a spring biased level adapted to releasably trap the tape.

According to still another embodiment of the present invention, the spring biased lever is adapted to release the tape under pneumatic pressure.

According to still another embodiment of the present invention, a hydraulically or pneumatically controlled piston in a compliance cylinder is adapted to maintain a constant pressure on the tape applicator head.

According to still another embodiment of the present invention, the cutting apparatus includes a knife blade that is located within the perimeter of the tape applicator head when the cutting apparatus is not in operation.

According to still another embodiment of the present invention, the tape applicator further includes a pneumatic or hydraulic blade control piston to control the knife blade operation.

According to still another embodiment of the present invention, the tape applicator further includes a knife blade sensor adapted to detect when the knife blade is fully retracted after the tape is cut and to signal the computer so that tape application can resume.

According to still another embodiment of the present invention, the tape applicator further includes vacuum ports adapted to provide sites of negative pressure against which the tape can be slideably held during application of tape to the work-piece.

According to still another embodiment of the present invention, the adhesion between the tape and the metal work-piece is improved by pretreating the work-piece. In some cases the work-piece has a film of oil (e.g., residual stamping fluid) that can reduce adhesion. The adhesion can be improved by high velocity air (including heated air), applying a cleaner, heating the work-piece, among other adhesion promoting steps.

According to still another embodiment of the present invention, the tape applicator includes an apparatus for splicing two tapes together. That is, the end of a first tape is sliced or connected to the beginning of a second tape. By splicing these two tapes, the tape application can be continuous.

According to still another embodiment of the present invention, the tape is dispensed from a cartridge that is in communication with the tape dispenser. The cartridge can be replaced as needed in order to deliver tape to the tape dispenser.

BRIEF DESCRIPTION OF THE DRAWINGS

The preferred embodiments are illustrated by way of example and not limited in the following figure(s), in which.

DETAILED DESCRIPTION OF THE PRESENT INVENTION

Figure 1:
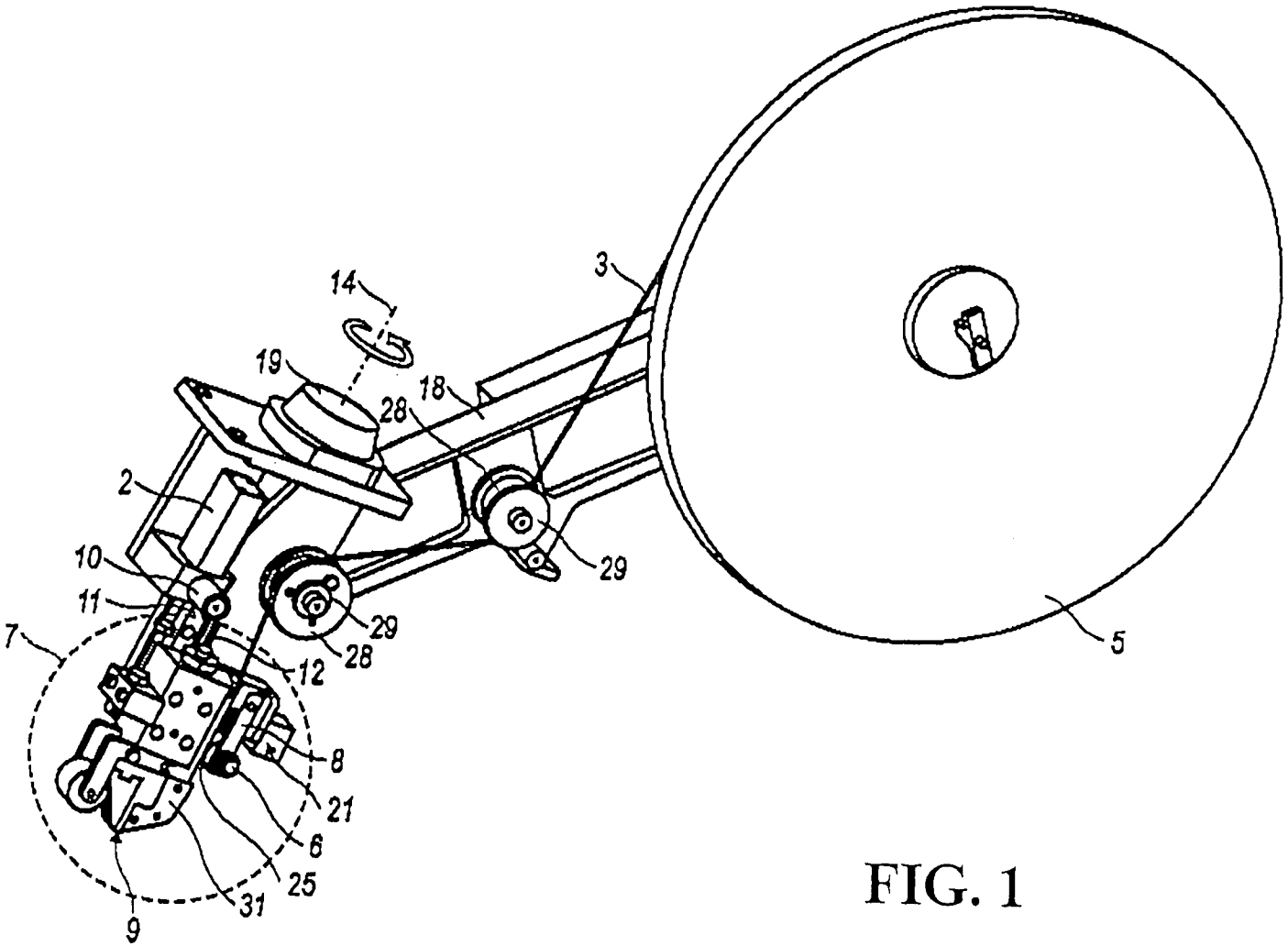
FIG. 1 depicts a perspective view of the robotic tape applicator in accordance with one embodiment of the invention.
Figure 6:
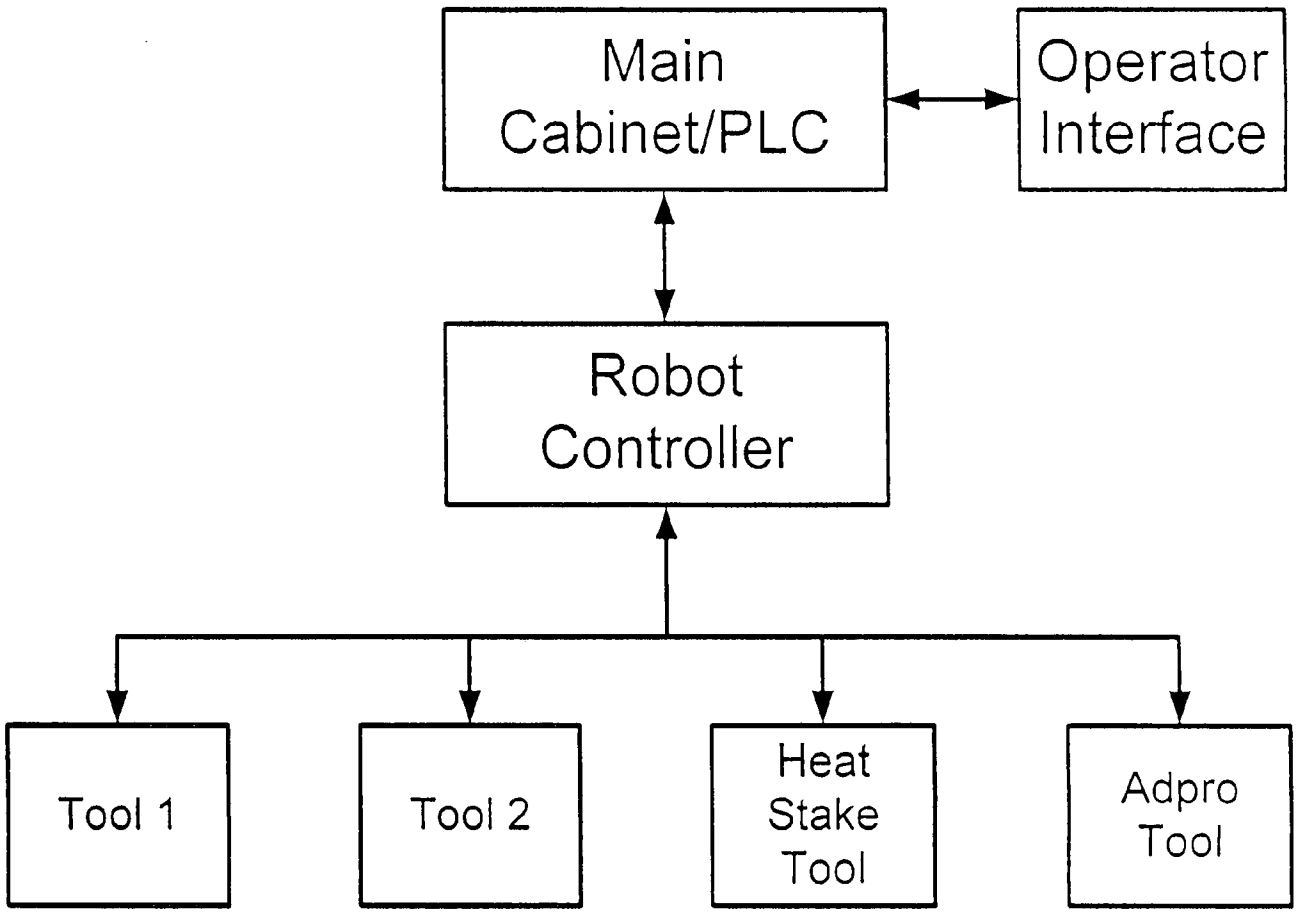
FIG. 6 depicts a schematic relationship view of the selected components in accordance with one embodiment of the invention.

The drawings are provided to illustrate certain embodiments of the invention and shall not limit the scope of any claims appended hereto. Referring now to the drawings, in which like numerals represent like elements, FIG. 1 illustrates a robotic tape applicator that includes a motion actuator, e.g., a robot, for transporting a tape applicator head (7) coupled thereto during tape application to a desired work-piece. Prior to applying tape (3) to the desired work-piece, such work-piece is placed onto or into a jig or work-piece holder (not illustrated) to secure the work-piece in place. The three-dimensional profile of the work-piece is recorded and stored in computer memory. Using appropriate programming, as understood in the art, a path for the tape in three dimensions is determined. The tape applicator head is then oriented so that, under the control of the computer (through the same or different programming), the head follows the predetermined path. The relationship of the computer to other components of the tape applicator system are illustrated in FIG. 6. Thus, the path programming data can reside in the PLC (programmable logic controller) shown in FIG. 6 or in a separate computer controller (not shown) that communicates with the PCL and robot controller to provide manipulation of the robot and tape applicator head (7).

In some cases, it is beneficial to pre-treat or clean the work-piece prior to applying the tape in order to improve or promote adhesion between the tape and the member/part to be sealed. For example, the work-piece can be cleaned in order to remove debris, residual metal working fluids, among other undesirable material. The work-piece can be pre-treated (e.g., heated), or cleaned by hand, or by an adhesion promoter which is adapted to follow the same path as the tape applicator head (e.g., refer to FIGS. 9, 10, 11 and 12).

Figure 2:
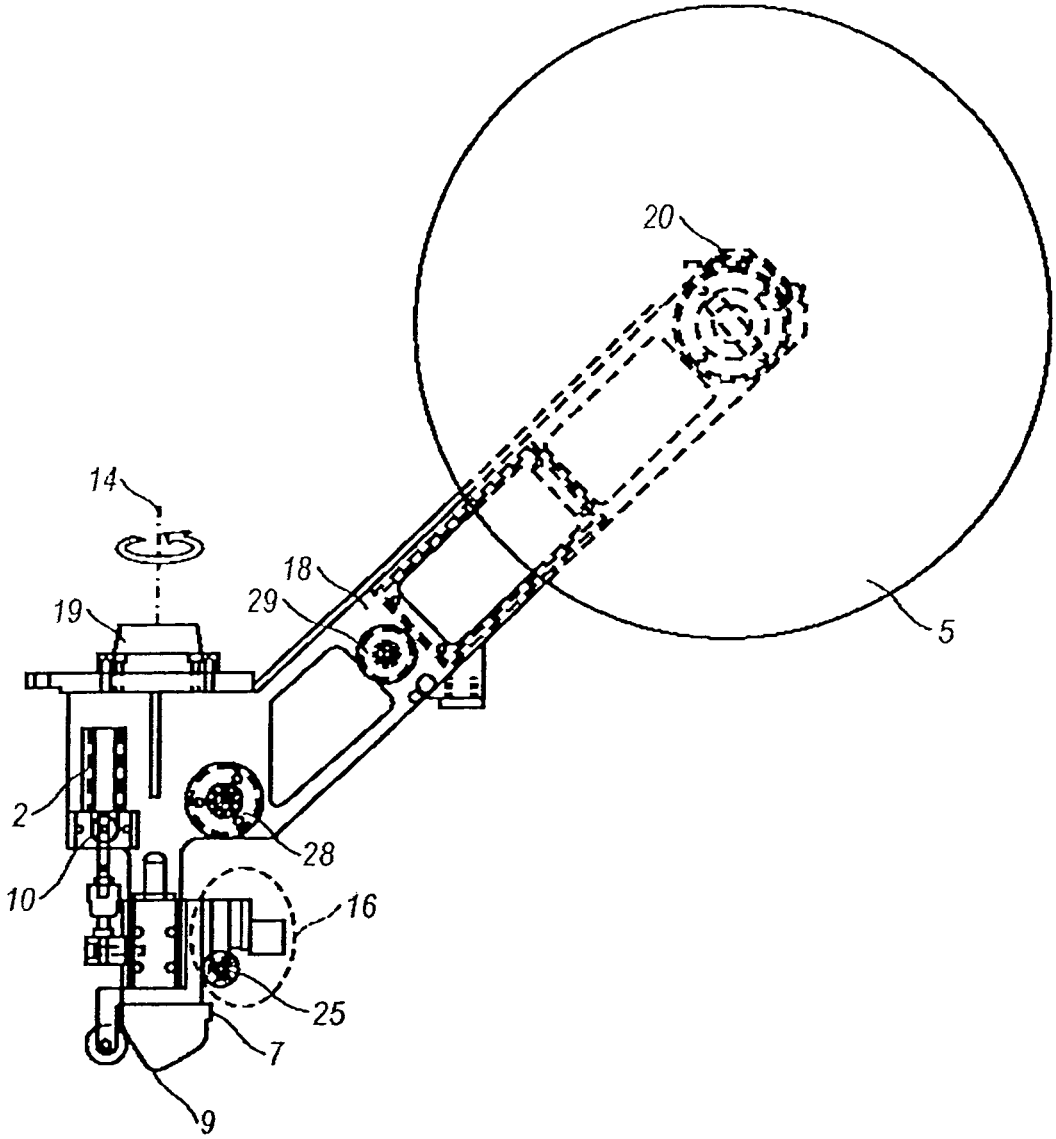
FIG. 2 depicts a partly cross-sectional side elevation view of the robotic tape applicator in accordance with one embodiment of the invention.

Referring to FIGS. 1 and 2, the tape (3) is rolled on a roller (5) which is mounted onto the applicator device (1) at a main bracket (18), one or more sensors (20) indicate the amount of tape remaining on a reel or roller. Normally, one side of the tape is covered by a non-stick removable covering or backing material. The tape is guided along a path through the applicator device to the tape applicator head (7). Tensioning apparatus (16) can be provided along this path in order to ensure that the tape remains under a uniform tension while it is being fed. In addition, braking apparatus (21) can be provided in order to restrain the tape from any movement during certain operations, including cutting of the tape as further described below.

When the robotic tape applicator is placed into operation, the applicator head can proceed to the precise location dictated by its computer controller, e.g., the robot controller (shown in FIG. 6). The tape application can then begin. Pressure in the head is maintained using pressure cylinder (2). The interface among the tape application steps is illustrated in FIG. 6.

The point of the tape applicator head (7) closest to the work-piece is referred to as the nose (9) which can be constructed as a nose piece capable of movement independently of the rest of the applicator head (7). In order to ensure that the tape is applied evenly without damage to the member to be sealed, the nose piece (9) is free to move reciprocally up and down in a direction normal to the surface of the work-piece. In one embodiment, a linear bearing (11) can be provided which allows the nose piece to move vertically in relation to the surface of the work-piece with a minimum of friction. Irregular motion of the tape applicator head (7) can introduce uneven tensions into the tape itself, so freedom of vertical motion for the applicator head (7) can be advantageous.

Figure 3:
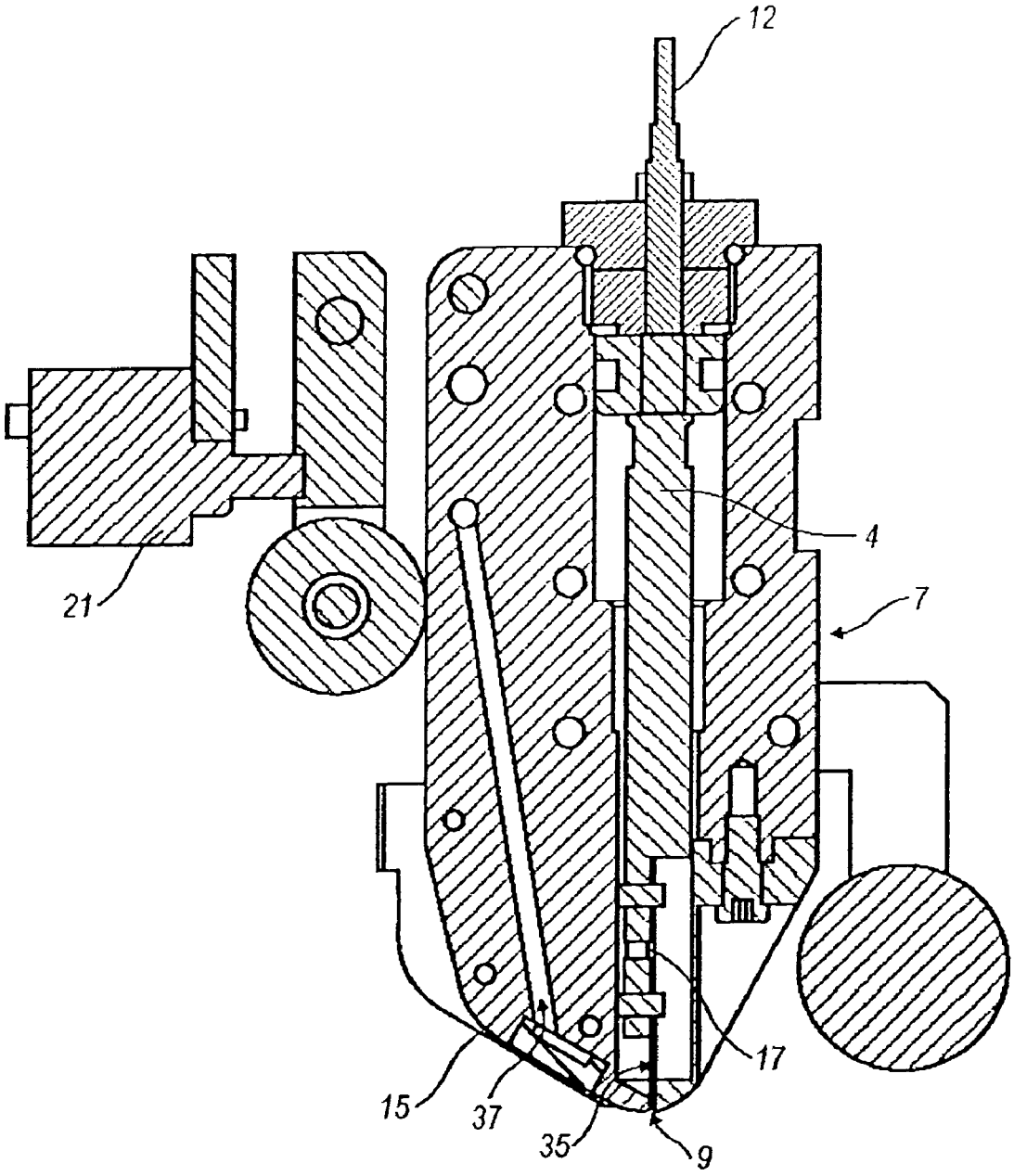
FIG. 3 depicts a cross-sectional elevation view of the tape applicator head in accordance with one embodiment of the invention.
Figure 4:
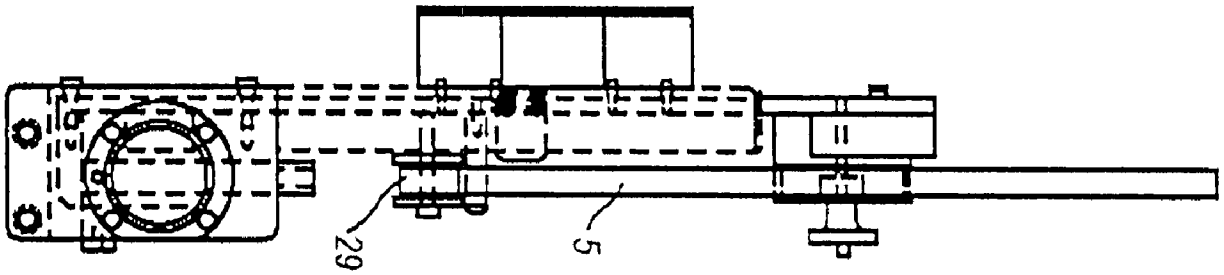
FIG. 4 depicts an end elevation view in partial cross-section of the robotic tape applicator in accordance with one embodiment of the invention.
Figure 5:
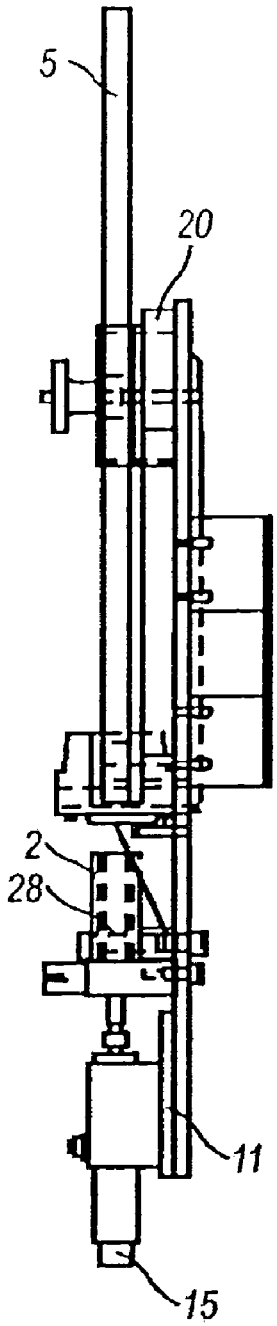
FIG. 5 depicts an opposite end elevation view in partial cross-section of the robotic tape applicator in accordance with one embodiment of the invention.

The amount of downward vertical force on the tape applicator head (7) depends upon the tackiness of the tape, surface characteristics of the work-piece, and/or other variables affecting adhesion between the tape and work-piece. If desired, a constant pressure can be maintained on the tape applicator head (7) by means of the pressure cylinder (2), which can be regulated by hydraulic or pneumatic forces. The pressure cylinder (2) can assist by providing a downward vertical force and allowing the head (7) to be in constant compliance with the work-piece. In addition, as illustrated in FIGS. 3 and 5, one or more lips or projections (15) on the side of the applicator head (7) can be provided to ensure constant compression of the tape. According to one embodiment, two lips (15) are provided so that one is in contact of the work-piece if the other is off it. The vertical dimensions of the lips (15) between which the tape runs are slightly less than the thickness of uncompressed tape so that a defined amount of compression of the tape can be created when the lips (15) are maintained in contact with the work-piece. Further, the lips (15) can be rounded and/or constructed or coated with a low friction material to minimize marring of the work-piece surface and to slide easily on the work-piece surface should they come in contact with such surface.

In order to apply tape in a controlled fashion, it is normally useful to cut the tape while the head (7) remains in contact with the work-piece so that the tape that has been applied cannot be pulled away from the work-piece. In one embodiment, as illustrated in FIG. 3, a cutting apparatus including a knife blade (17) is provided which is located within the external profile of the tape applicator head (7). For certain work-pieces, it is necessary for the tape applicator head (7) to move within a fairly narrow or confined space, so a small nose on the tape applicator head (7) is beneficial. By incorporating the blade (17) into the nose (9) so that it does not protrude when the tape is in motion, the best results are achieved.

When the cutting apparatus includes a knife blade (17), such blade operates under the control of a knife blade control piston (4). Referring to FIG. 1, when it is desired to cut the tape, a tape braking apparatus (21) presses the tape firmly into contact with a portion of the applicator head (7). This locks the tape so that as the tape head (7) pulls away from the work-piece, the tape does not unwind any further from the roller (5). Owing to the orientation of the tape as it is laid down, the braking apparatus (21) could be applied against the adhesive side of the tape. Accordingly, it is beneficial to coat the braking apparatus (21) with a non-stick surface so that it cannot adhere to the adhesive side of the tape. A spring-loaded lever (8) can be used to pivot the braking apparatus (21) against the tape in order to trap the tape between the nose (9) and the braking apparatus (21). Accordingly, an air release mechanism (10) can be used to release the brake apparatus (21) against the tape.

If the knife blade (17) is not fully retracted before the tape is applied, the tape can be cut or scraped in a unwanted manner. Accordingly, in one embodiment, a knife blade sensor (12) is provided to ensure that the knife is fully retracted before tape application commences or recommences.

Figure 8:
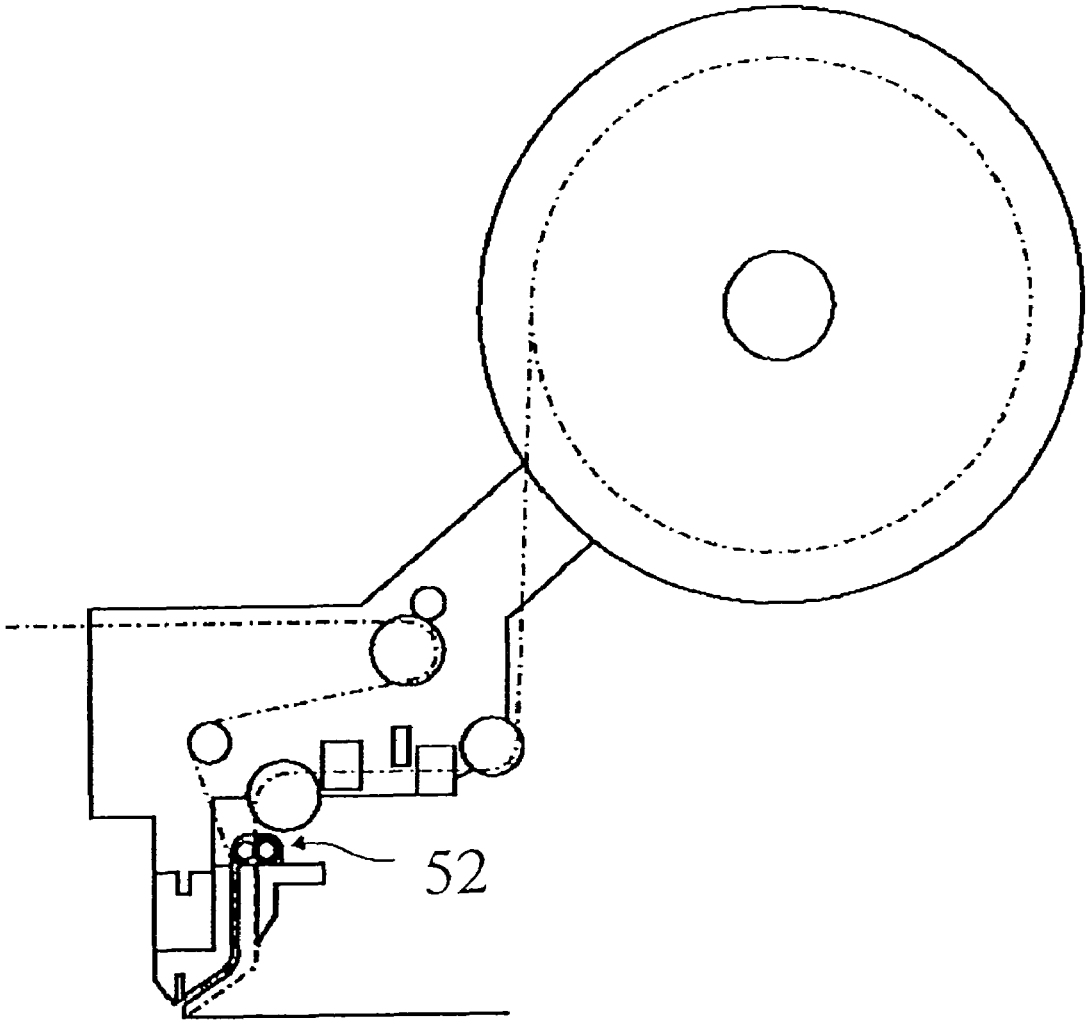
FIG. 8 depicts a side view of an apparatus for cutting tape in accordance with one embodiment of the invention.

In another embodiment, the cutting apparatus includes a cutting station having a rotary die or knife as illustrated in FIG. 8. The cutting station can interface with the computer apparatus. The rotary die can include two rollers that are spaced apart a sufficient distance to receive the tape therebetween. In this case, one of the rollers (e.g., the one on the right shown in FIG. 8) is equipped with a cutting edge, so that when tape cutting is desired, the cutting roller is pushed or pressed against the tape, and due to the movement of the tape, the cutting roller rotates so that the cutting edge can cut the tape. The rotary die can also include a roller and an anvil (e.g., mandrel) wherein the tape passes between the mandrel and roller. In this case, the cutting roller (also shown on the right in FIG. 8) is pushed or pressed against the tape to cut the tape against the mandrel (in place of the roller on the left in FIG. 8) during tape cutting. In either case, the rotary die cuts through the material to be applied but not through the carrier or removable backing of the tape. The rotation speed of the rotary die can approximate the linear velocity of the tape being applied. The cutting apparatus can be employed for cutting the tape into relatively small pieces (prior to application), embossing, or to ensure that a predetermined length of tape is applied onto the work-piece.

Figure 12:
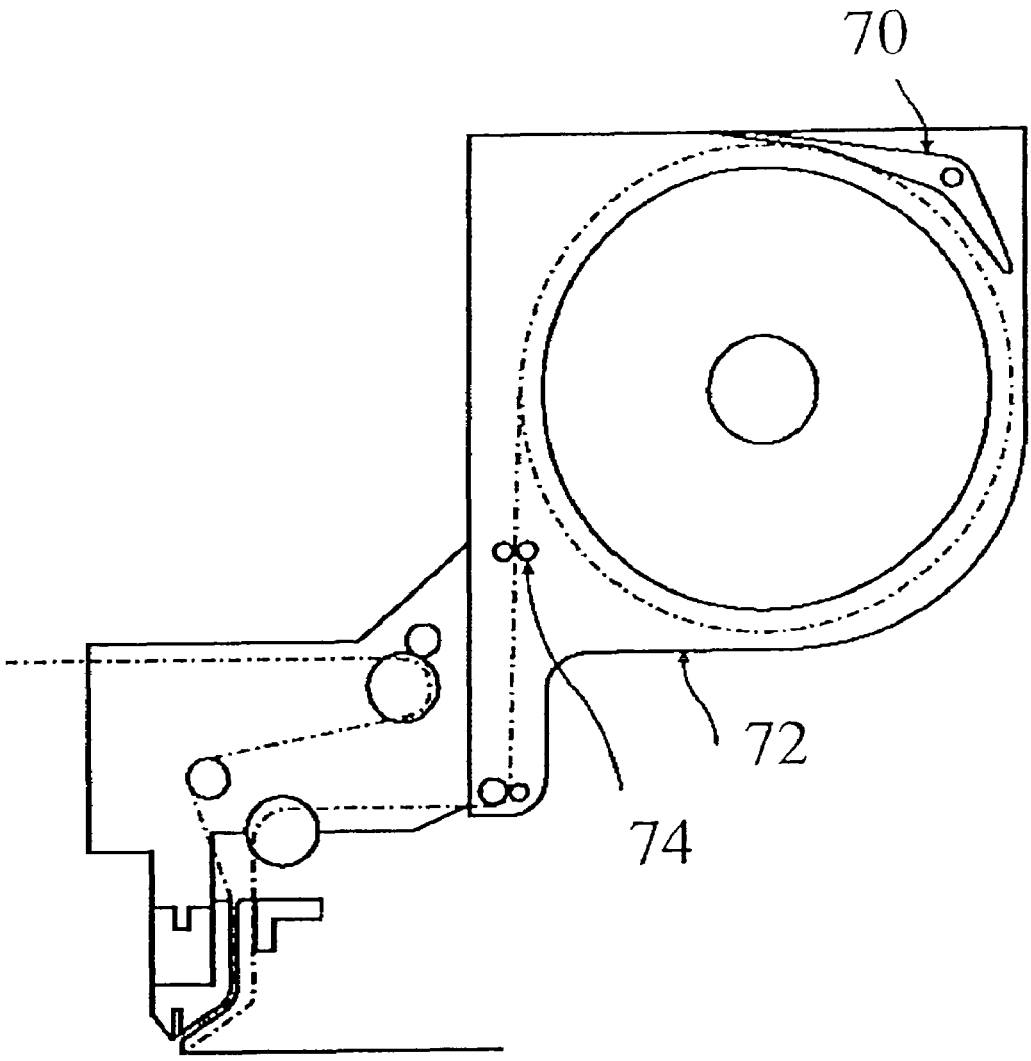
FIG. 12 depicts a side view of a tape cartridge in accordance with one embodiment of the invention.

It is beneficial to maintain a constant tension on the tape during tape application. In one embodiment, a nip roller (25) provides a point of constant tape tension regardless of the amount of tape on the roll. As the radius of the tape on the roll decreases, the tension on the tape can vary unless such a tape tensioning mechanism is employed. The nip roller (25) mechanism (one such roller is shown in FIG. 1, and two such rollers are shown in FIG. 12) can include a polished steel shaft with a sapphire tube over the shaft to create a small diameter roller for the tape to run over. This reduces the friction of the tape on the nose (9) due to the capstan effect and thus further reduces the torque required to feed the tape through the tape applicator head (7).

In order to keep the tape moving completely in line with the tape applicator head (7), side guides can be provided. For instance, in one embodiment, crown guides (28) on the idler rollers (29) keep the tape moving in a straight line with the applicator head. These side guides (28) can also be covered with a non-stick coating in order to prevent the tape from dragging, thus avoiding unwanted tensions. Also, side guide plates (31) can be located at one or more locations on the head (7) of the tape applicator in order to help guide the tape. In one embodiment, the side guide plates (31) are extended down to the application area of the nose (9) as shown in FIG. 1. This is critical for maintaining the proper tape tension and guidance when the head is negotiated around tight curves (i.e., curves with small radii).

As set out above, a spring applied/air release braking apparatus (21) keeps the assembly locked during cutting of the tape in order to prevent tape movement. It is intended that the tape should remain in contact with the work-piece without any movement after it has been laid down. The pressure cylinder (2) is also locked when the braking apparatus (21) are applied.

Figure 14:
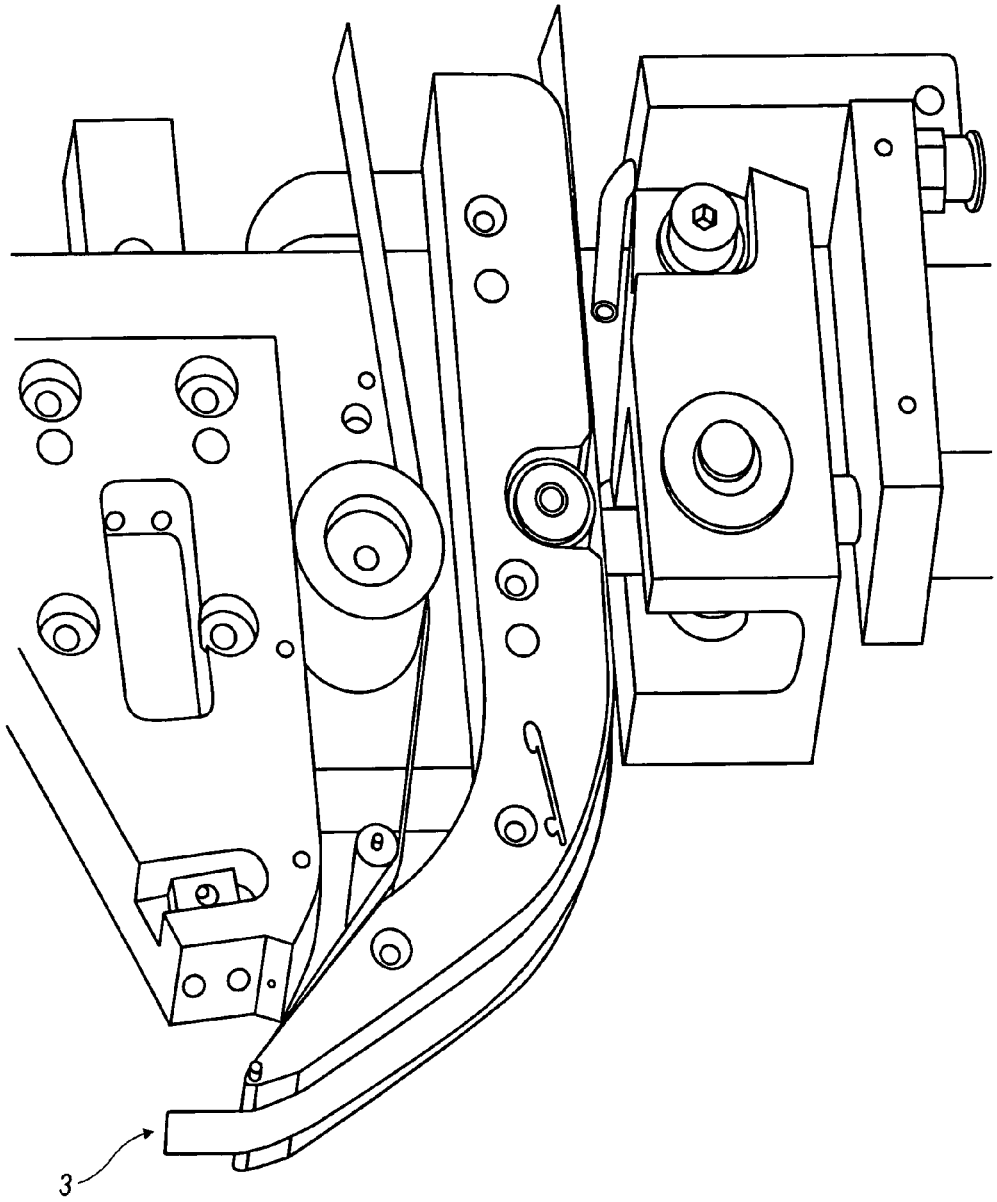
FIG. 14 depicts a view of a flattened nose section of the tape applicator head in accordance with an embodiment of the invention.

The shape of the nose (9) can affect the efficiency of tape application. A smooth radius at the tip of the nose (9) prevents excess tension in the tape (3). If the center point (35) of the radius of the nose tip (as shown in FIG. 3) is in line with the roll axis (14) of the robot arm (as shown in FIGS. 1 and 2), optimum results can be obtained. The roll axis of the robot is the tool point around which the robot rotates. When the center point of the radius at the tip of the nose is in line with the roll axis of the robot, it is possible to take advantage of the circular programming functions of the robot to create extremely smooth arcing motions. According to another embodiment of the present invention, the application area of the nose (9) can be flattened out just before the backing/tape separation interface (as shown in FIG. 14). This allows the compliance pressure load to be spread over a larger area and eliminates creases in the sealer during the tape application due to high point loading.

In another embodiment, one or more vacuum ports (37) in the applicator head (7) are provided in order to assist the tape to adhere against the surface of the tape applicator head (7) for control after the tape cutting. The vacuum assists in holding the non-adhesive backing cover of the tape to the nose (9) during the taping operation. When vacuum is being drawn, the tape is urged into contact with the tape applicator head (7) by ambient air pressure. Although this vacuum can be turned on and off as required, every such change results in a certain amount of cycling time. Since it is beneficial to reduce cycling times, a constant vacuum can be maintained if it is of a strength which allows the tape to move along its intended path while drawing it into contact with the tape applicator head (7). Further, as shown in FIG. 14, a number of air ports or airjets (37) can be provided on the tape application surface of the nose (9) to allow more air bearing effect around the nose (9). This reduces the friction of the tape on the nose (9) due to the capstan effect and thus further reduces the torque required to feed the tape through the tape applicator head (7). According to embodiments of the present invention, these air ports (37) are useful in certain areas of high load or contact between the tape and the steel surface of the nose. The number of air ports (37) desired can depend on the length and shape of the nose assembly.

It should be noted that FIG. 14 depicts a tape applicator head that varies from the tape applicator head (7) previously depicted in FIGS. 1 and 2. The purpose of FIG. 14 is to provide an illustration of tape application area of the nose (9) and possible locations for the air ports or airjets thereon, as described above. FIG. 14 also provides an illustration of a tape application area of the nose (9) that is flattened out just before the backing/tape separation interface, as mentioned earlier in accordance with one embodiment of the present invention.

As shown in FIG. 1, a tool changer (19) on the robot is used to change from one tool to another depending on the requirements of the tape application task. The tool changer (19) can have any desirable structure. Examples of such includes snap-fittings, compression fittings, manually operated connections, among other devices and/or methods for removably connecting the tape applicator head (7) or another tool to the robot.

The tape applicator head (7) can be adapted to accommodate a wide range of tape widths. If desired, two tape heads can be dedicated to each tape width. In this way, the operator could replenish the tape supply without shutting down the process. The heads can be stored in a rack that was easy for the operator to reach from outside the cell location. According to one embodiment of the present invention, the head includes:

Tape reel and sensor;

Tension control;

Application pressure cylinder and control valves;

Application roller;

Cutting apparatus;

Optionally quick-change tooling; and

Optionally at least one member selected from the group consisting of a tape splicing apparatus, cutting station, adhesion promoting station such as a cleaner (e.g., high velocity air) or heater, and cartridge controller-changer.

A new roll of tape can be removably connected to the main bracket (18). The new roll of tape can be changed manually or robotically. If desired, the tape can be dispensed from a replaceable and refillable cartridge (e.g., as illustrated in FIG. 12). The orientation of bracket (18) can be modified depending upon the range of motion required by the robot for applying the tape. A typical application can have the reel adjacent to the applicator head to above the first joint on the robot or adjoining a stationary table behind the robot. If an unwind station is located remote from the robot then the tape should be encased in a structure that would protect the tape from dirt and debris and any other harmful conditions that can inhibit the effectiveness of the tape.

During the tape application, the system was capable of negotiating curves as well as straight runs of tape. The tape application roller provided the normal force on the tape as it was applied. The tape was cut off at the end of each tape run by the cutting apparatus. The removable backing material is removed from the tape applicator after applying material to the work-piece. The backing material can be removed by any suitable apparatus and/or method that does not adversely affect applying material or operation of the robot (e.g., passing the backing material over rollers and then into a collection system).

The tape is drawn from the reel due to adhesion or friction between the tape and the work-piece. If desired, the tape applicator could employ a driven system to apply the sealer instead of using adhesion or friction. A driven system can allow less tension to be applied to the sealer thereby preventing unintended tape dispensing (e.g., uncut tape becomes adhered to the work-piece surface thereby causing unintended tape dispensing as the tape applicator is displaced).

In one embodiment of the invention, the method for applying the tape includes causing the tape in the tape applicator to first contact the work-piece at a predetermined location and remain at this location for a period of time sufficient to permit the tape to adhere to the work-piece. The first contact location can be at any desirable location along the path over which the tape can be applied. The adhesion or bond formed at the first contact location can increase the effectiveness of tape application (e.g., in the case of an oily work-piece the initial bond permits the tape to unreel along the application path instead of sliding across the work-piece surface without being dispensed). If desired, a downward pressure can be applied at the first contact location. This downward pressure can mimic a manual tape application. After the first contact, the tape is applied as described herein.

Figure 7:
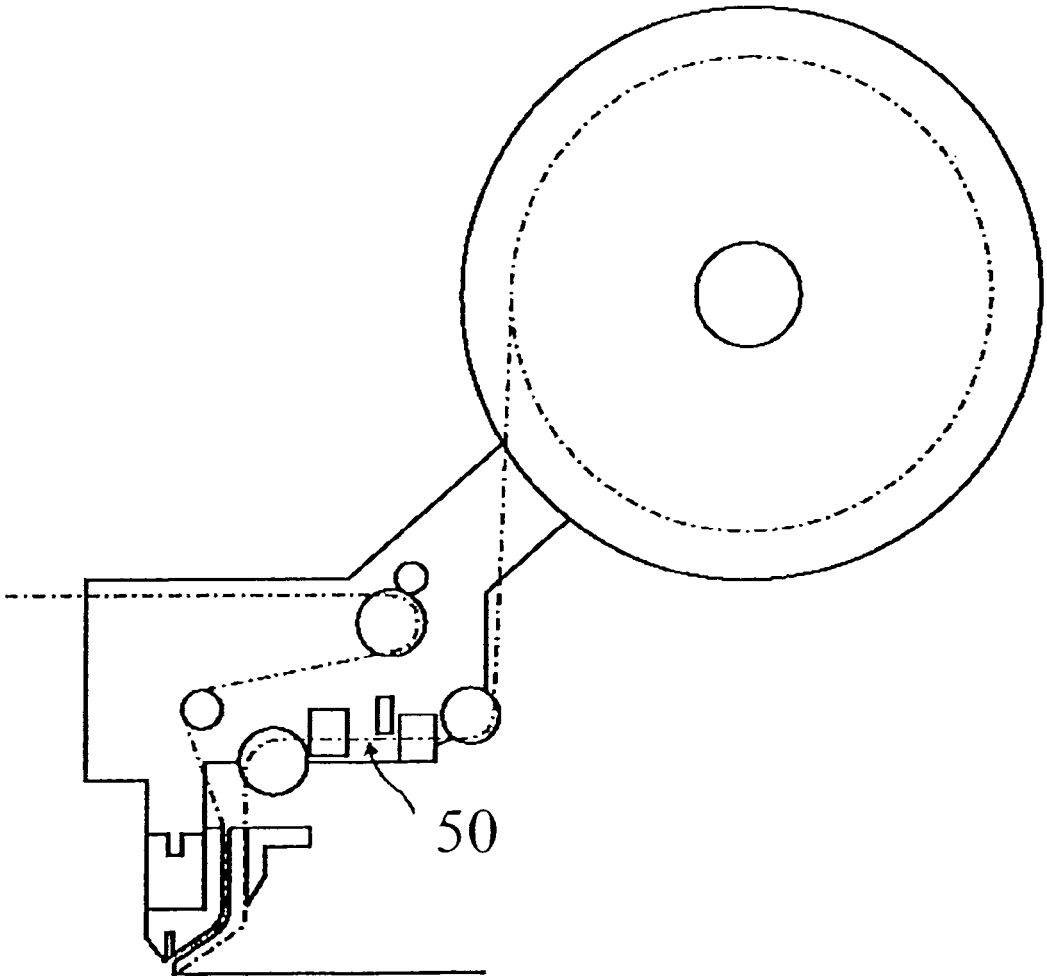
FIG. 7 depicts a side elevation view of an apparatus for splicing two tapes together in accordance with one embodiment of the invention.

The tape applicator illustrated in FIGS. 1–5 can modified by including at least one of the apparatuses illustrated in FIGS. 7–12. Referring now to FIG. 7, a splicing apparatus can be employed for connecting or splicing the end of one tape to the beginning of another tape so that the automatic tape applicator can automatically thread. In some cases the beginning andlor end of the tape includes the removable backing material (e.g., a leader without material to be applied onto the work-piece). The absence of material to be applied can enhance the splicing process. This is because the material can contain a release coating under the material that allows it to loosely adhere to the backing; thus, such release coating can hinder the splicing of the tape ends. The splicing apparatus can include an automatic splicing station (50) having clamps or other structure that applies a compressive force onto the tape ends. If desired the splicing station (50) can further include a device for applying an adhesive; for example, such device can include an adhesive dispenser and a contact forcing mechanism for applying the dispensed adhesive to ends of two separate tapes, or to just one end of one tape, depending on the type of adhesive used, to connect those tape ends together. If employed any suitable adhesive can be used such as conventional pressure sensitive adhesive, a double sided splicing tape with a backing for stiffness, among other methods for connecting tape ends. In one embodiment, the tape ends include a previously applied adhesive that is protected by a removable tab.

Referring back to FIG. 8, which illustrates a cutting apparatus that can be used for cutting the material before application. While any suitable cutting apparatus can be used, the apparatus can include cutting the material to be applied (e.g., mastic) before or after application. For example, as described earlier, the cutting apparatus can be a cutting station (52) having a rotary knife that can cut against a hard anvil so as to cut the adhesive but not the carrier. This can provide a clean cut when the robotic tape applicator reaches the end of the cycle, i.e., programmed path.

Figure 9:
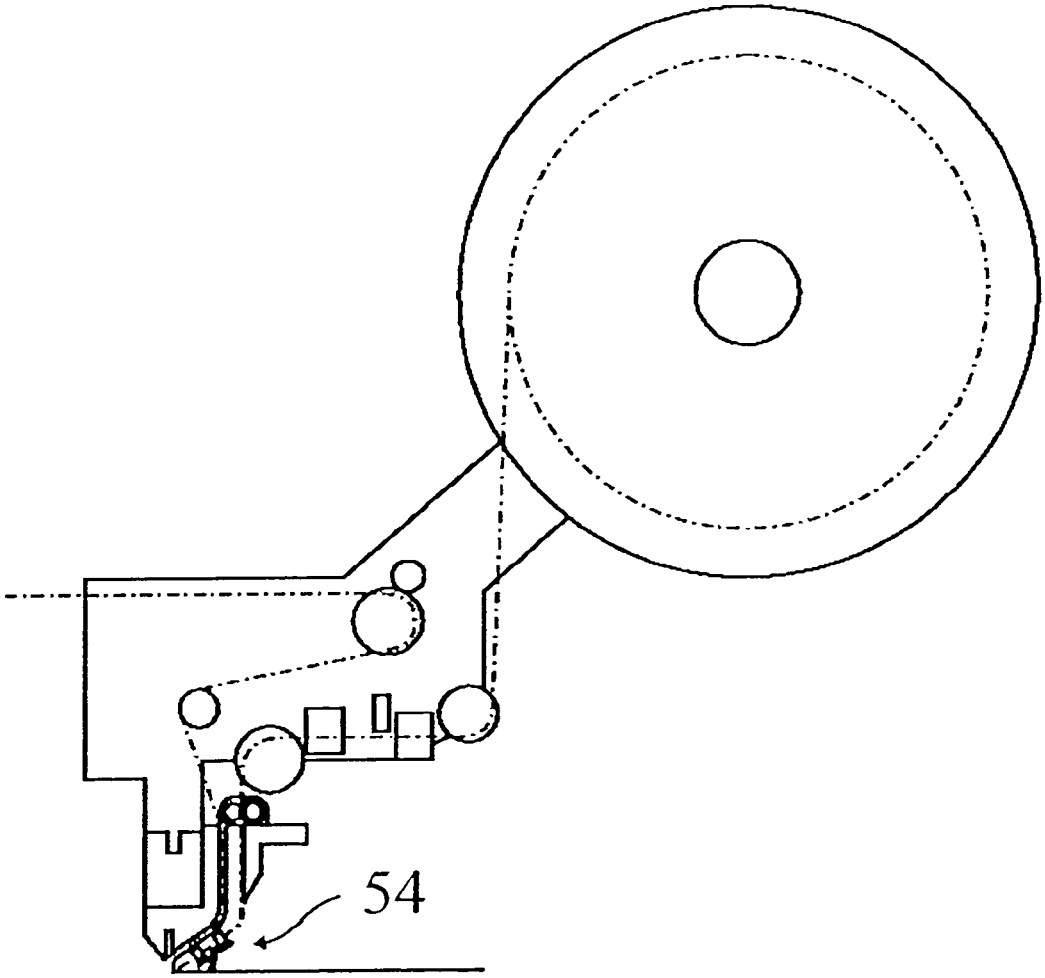
FIG. 9 depicts a side view of an apparatus for improving tape adhesion in accordance with one embodiment of the invention.

Referring now to FIG. 9, which illustrates an adhesion promoting apparatus that includes a cleaning mechanism that can be used to remove debris/oil and other residues from the application surface of the work-piece. The cleaning mechanism (54) can be connected to the tape applicator and clean the work-piece immediately before the tape application (e.g., the cleaning mechanism (54) removes undesired substances in the path of the tape applicator). The cleaning mechanism (54) can include a sweeping material such as a sponge, chamois, cork, rubber, among other materials that would produce a squeegee effect, or a tacky material; all of which would remove or relocate material from the path of the tape applicator. The cleaning mechanism (54) can also include a system for dispensing a fluid that assists in removing undesirable material (e.g., a sponge that dispenses a volatile cleaning solution such as alcohol), as shown in FIG. 9 as the adhesion promoter. If desired an air-blast can be combined with the cleaning mechanism (54) (this air blast can be different from the one shown in FIG. 11). The air-blast can also be used for removing any cleaning fluid or undesired substances remaining on the work-piece after the sweep. The air-blast could produce a high velocity of air that would blow any debris/oil out of the path of the applicator. If desired, the air could also be heated or cooled depending on the desired results, as is further described below with reference to FIG. 11.

Figure 10:
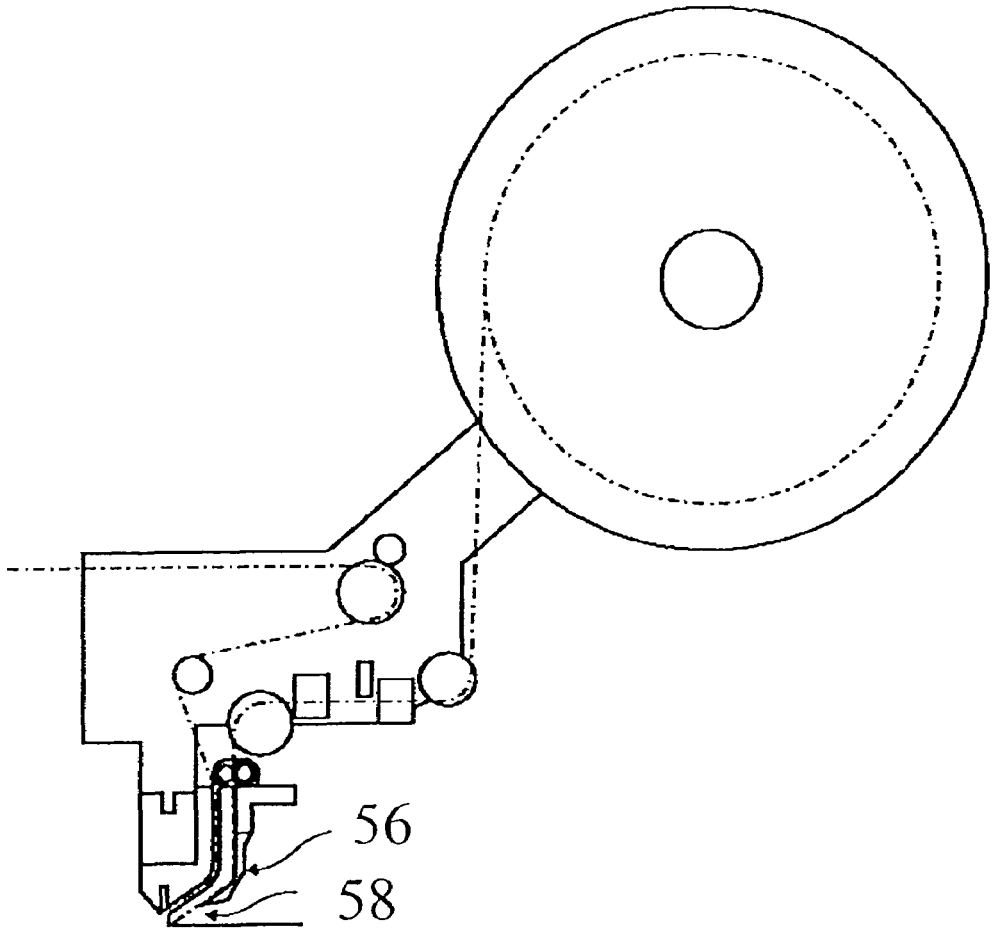
FIG. 10 depicts a side view of an apparatus for improving tape adhesion in accordance with another embodiment of the invention.

Referring now to FIG. 10, which illustrates another apparatus for promoting adhesion between the tape and the work-piece by introducing heat such as hot air into the conveying area, whereby it is directed towards the adhesive application area. The illustrated apparatus (56) includes a heater that wanns the tape prior to contacting the work-piece. The heater can include any suitable apparatus such as an infra-red heater, hot air, among other apparatus for increasing the temperature of the tape and in turn the adhesive qualities of the material being applied. The heater can be connected to the tape applicator and travel with the tape applicator, or in a separate structure (e.g., that is maintained at a fixed location relative to the work-piece). If desired, the adhesion promoter apparatus (56) can also heat the surface of the work-piece (58).

Figure 11:
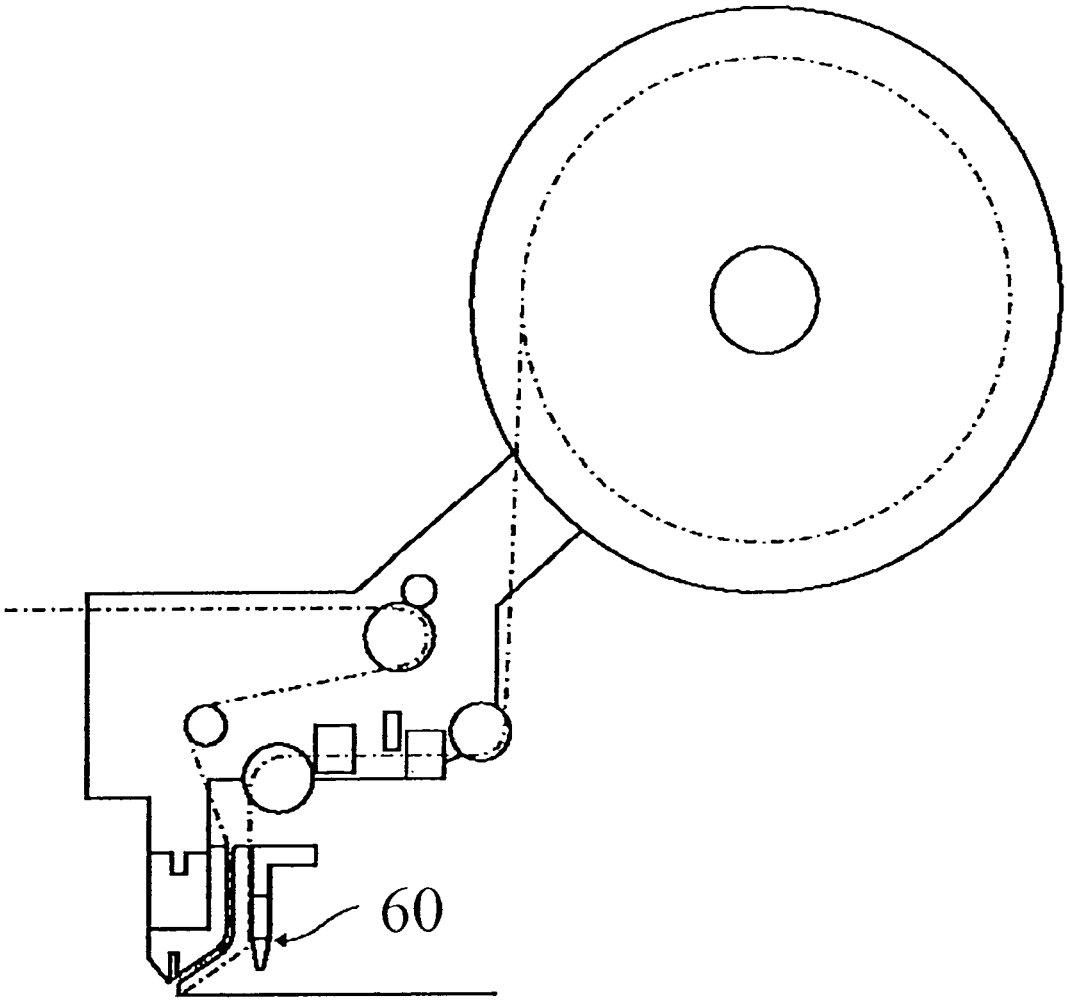
FIG. 11 depicts a side view of an apparatus for cleaning the work-piece surface in accordance with one embodiment of the invention.

Referring now to FIG. 11, FIG. 11 illustrates an apparatus for promoting adhesion that can modify the surface temperature as well as clean the work-piece surface. The temperature modification apparatus can include any suitable apparatus (e.g., an infrared heater as shown in FIG. 10, water chiller, among other apparatuses for either heating or cooling the work-piece surface) that is combined with a blowing system (e.g., a vortex apparatus). The blowing system can clean the work-piece surface while also modifying the work-piece surface temperature. The blowing system can heat or cool on demand via a temperature controller that is used to heat the entire surface that the sealer is being applied to or the sealer itself. The temperature modification apparatus can also function to reduce humidity in the tape application area. For example, the blowing system can be ajet blast cleaner (60) shown in FIG. 11 that provides a high speed blast of air to clean the application surface of oil compounds. A vortex heater can also be used as the temperature modification apparatus to heat or cool the jet blast cleaner (60) and application surface.

Referring now to FIG. 12, which illustrates a cassette or cartridge that can be used for dispensing tape into the tape applicator. The cartridge (72) can be used for storing, loading, and unloading of tapes. The cartridge (72) can be manually or automatically removed (e.g., by the robot) from the tape applicator and refilled with tape. The cartridge (72) can include a dispensing reel, tension reel, drive mechanism that could be geared or self driven, and one or more mechanisms for removably connecting the cartridge (72) to the tape applicator. The cartridge (72) can further include side plates to keep the tape straight and not prematurely unwind off of the spool. Thus, the cartridge (72) provides transportation of finished adhesive reels (i.e., tapes), protection of the reels from contamination, automatic changes of tapes, automatic de-reeling and splicing of tapes. The cartridge (72) can be fabricated from any suitable material such as plastic, injection-molded thennoplastic, among other suitable materials. One-way bearing can be used to keep the tape from slipping during shipping. A non-stick material can be applied to the nip rollers, shown as the nip roll (74) assemblies in FIG. 12, in the cartridge (72) to keep the tape from sticking to the nip rollers. A roll balancer (70), as so labeled in FIG. 12, can also be used to support the tape to help maintain shape and roll quality during shipping and storage. In one embodiment, the roll balancer (70) can be spring-loaded or similarly arranged so as to maintain sufficient pressure on the tape wounded on the reel in the cartridge (7g.) so that the tape remains tightly rolled up and maintains its shape (e.g., the tape does not become twisted) during tape application.

A method of monitoring the amount of tape previously dispensed could be employed. This could include an encoder counter that would count the number of inches of tape dispensed, and report that back to the robot controller for evaluation of amount of tape needed vs. amount on the reel (e.g., refer to FIG. 6). This method can further include one or more sensors that detect the amount of tape on the reel.

In one embodiment of the invention, a barcode label or magnetic strip or any other device is used to transfer information. The barcode can be used to identify the type, quantity of sealer enclosed in the cartridge, among other information. This information can be used to ensure that the appropriate tape and amount thereof is applied onto the work-piece. An example of this embodiment is illustrated in FIG. 13.

Figure 13:
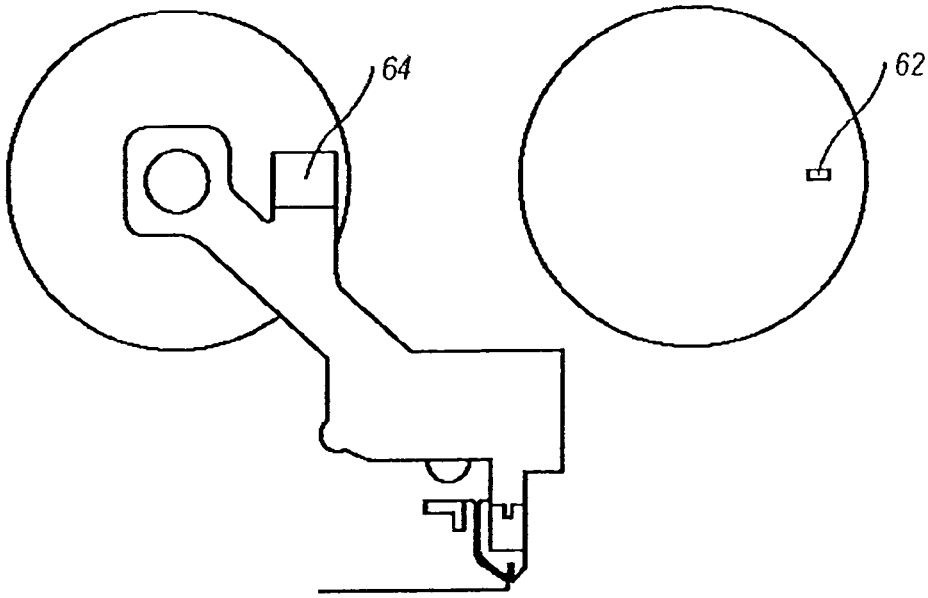
FIG. 13 depicts a side view of a tape cartridge having optical reader capability in accordance with an embodiment of the invention.

Referring now to FIG. 13, which illustrates an optical or vision system that can be used for monitoring and operating the inventive robotic system. The optical system illustrated in FIG. 13 includes an identification tag 62 (e.g., bar code or magnetic strip) on the cartridge or reel of tape. The information contained in the tag can include product number/type, date of manufacture, length, path/application pattern, application speed, among other tape and application specific information. The information contained in the identification tag is read by an optical scanner 64 of the optical system, which is located on the tape applicator head (7), and evaluated by the computer control system (e.g., refer to FIG. 6) prior to applying the tape. The computer system can accept the information and proceed with tape application, or reject the reel (and report an error, signal an operator, etc.). The computer system can further use such information to call up a specific tape application routine. The identification tag or information can be located at any suitable location such as on an exterior surface of the cartridge, a leader or beginning portion of the tape, among other locations accessible by the optical scanner.

The optical or vision system can also include a detector in the tape applicator head (7) to ensure the tape is being applied onto the work-piece along a predetermined path or configuration. The computer control system can modify the tape applicator direction to ensure proper tape application based on information received from the optical/vision system. The optical system can also confirm that tape is being applied onto the work-piece (as a redundant system to the system monitoring the amount of tape of the cartridge).

It should be noted that the various components, apparatuses, and systems shown in FIGS. 7-13 and/or described above can be used separately or in any combination as parts of the robotic tape applicator.

In a further embodiment of the invention, a self-threading machine or apparatus could be used introduce tape from the reel and into the tape applicator (e.g., when the tape is not loaded into a cartridge). This could include a miniature robot that could take the sealer off the reel and thread it through the applicator head. This self-threading machine could be located on the applicator head or in a different location.

In another embodiment of the invention, the tape application is monitored by using a camera system or several sensors. This system can be used to monitor operation of at least one of the robot, applicator head, cartridge dispenser, apparatus for adhesion promotion, cutting station, among other embodiments of the invention. This system could also monitor sealer movement through each reel, tape application pressure, tape tension, among other variables associated with conducting the instant invention.

In a further embodiment of the invention, an applicator can be used to apply a die cut shape instead of a roll of tape. The die could also be used for embossing or shaping the tape prior to or during application onto the work-piece. This head can include vacuum pads placed in strategic locations to support the die cut tape in the appropriate positions that would allow a robot to apply the tape to a predetermined position.

In a further embodiment of the invention, the tape applicator head (7) can be oriented into a horizontal position when not in use. This orientation is especially useful when working with relatively soft tapes. Such relatively soft tapes can deform if the applicator is maintained in a vertical stationary position (e.g., depending upon the ambient environment, the tape can change [flow due to gravity] from a generally round configuration to an oblong dimension). The applicator head should also be in a horizontal orientation when in the reloading position, and as it is being stored prior to changeover for an empty reel.

Any suitable robot can be employed for transporting the tape applicator. The robot can be new or an existing robot can be retrofitted to receive the inventive tape applicator. An example of a suitable commercially available robot includes a Fanuc S-5$^{th}$ Robot was chosen for the activator and tape application due to the shape and size of the part to be taped. On many of the parts, a large reach combined with the ability to manipulate the tool at a complex tilt is required. The six-axis, articulated robot was programmed based on the nominal contours of the 3-dimensional mathematical part profile data. This was used to generate the basic tool path for the part. Any difference in shape due to moisture content and shrinkage was accommodated by the end of arm tooling. The robot has the capacity to store a multitude of robot paths.

While the above description emphasizes using the tape applicator head for applying an adhesive, a sealant, structural or sound abatement material upon an automotive component, the tape head can be used for applying tape to a wide range of automotive and non-automotive surfaces. Examples of such surfaces include steel, galvanized metal, aluminum, among other metals, glass, composites, carpets, pads, plastic, alloys and materials used in automotive construction. Examples of additional automotive and non-automotive components include: previously painted articles, exterior and interior trim articles, among other areas of an automobile; windows, doors, and other building components. In addition, the tape applicator head can be employed for applying tape to non-metallic surfaces such as plastic, foam, wood, among other materials wherein it is desirable to apply a tape. Furthermore, the tape applicator head can be used to apply or construct gaskets or weatherstrippings. Thus, the tape applicator head generally can be used to apply one or more strips of any material to any surface and along any path as desired.

Although the invention has been described with reference to these preferred embodiments, other embodiments could be made by those in the art to achieve the same or similar results. Variations and modifications of the present invention will be apparent to one skilled in the art based on this disclosure, and the present invention encompasses all such modifications and equivalents.

The invention claimed is:

1. A tape application system comprising:

a computer which includes programmed data respecting a shape of a work-piece and a proposed path of a first tape to be applied to the work-piece; and an tape applicator head controlled by the computer to apply the first tape to the work-piece along the proposed path, the tape applicator head comprising:

a braking assembly for locking the first tape during cutting; and a cutting mechanism controlled by the computer capable of cutting the first tape;

a tensioning mechanism capable of maintaining a substantially constant tension on the first tape during the tape application to the work-piece;

a nose capable of permitting reciprocal motion in a direction normal to the work-piece; and at least one side guide plate extending down to a tape application area of the nose to guide the tape, wherein the tape application area of the nose is flat.

2. The tape application system of claim 1, wherein the tensioning mechanism comprises:

a shaft; and a sapphire tube over the shaft to form a nip roller.

3. The tape application system of claim 2, wherein the shaft comprises a polished steel shaft.

4. The tape application system of claim 1, wherein the nose comprises a stationary radius, the center point of the radius lies along the proposed path of the first tape to be applied to the work-piece.

5. The tape application system of claim 1, wherein the nose comprises at least one air port that releases air to reduce friction between the first tape and the nose.

6. The tape application system of claim 1, further comprising:

a splicing station that splices an end of the first tape to a beginning of a second tape.

7. The tape application system of claim 6, wherein the splicing station comprises a clamp that applies a compressive force onto the end of the first tape and the beginning of the second tape.

8. The tape application system of claim 6, wherein the splicing station is under control of the computer.

9. The tape application system of claim 1, wherein the cutting mechanism comprises a rotary knife that cuts the first tape against an anvil.

10. The tape application system of claim 1, wherein the tape applicator head further comprises:

a cleaning mechanism that cleans a tape application area of the work-piece prior to the application of the first tape.

11. The tape application system of claim 10, wherein the cleaning mechanism comprises a sweeping material that sweeps away any undesirable material from the tape application area of the work-piece.

12. The tape application system of claim 10, wherein the cleaning mechanism comprises:

a fluid dispenser that dispenses fluid to remove any undesirable material from the tape application area of the work-piece.

13. The tape application system of claim 12, wherein the tape applicator head further comprises:

an air blaster that removes the dispensed fluid and the undesirable material from the tape application area of the work-piece.

14. The tape application system of claim 1, wherein the tape applicator head further comprises:

a heating element that produces heat directed at the tape application area of the nose.

15. The tape application system of claim 1, wherein the tape applicator head further comprises:

a heating element that produces heat directed at a tape application area of the work-piece.

16. The tape application system of claim 1, wherein the tape applicator head further comprises:

a temperature modification mechanism that provides a temperature changing effect to a tape application area of the work-piece;

a blowing system for directing the temperature changing effect to the tape application area of the work-piece.

17. The tape application system of claim 1, further comprising a cartridge coupled to the tape applicator head to dispense the first tape to the tape applicator head.

18. The tape application system of claim 17, further comprising:

an identification system that includes:

an identification tag on the cartridge to identify a type of the first tape dispensed to the tape applicator head; and a scanner that scans the identification tag to identify the first tape.

19. The tape application system of claim 18, wherein the proposed path of the first tape to be applied to the work-piece is based at least on the scanning of the identification tag by the scanner.

20. The tape application system of claim 1, wherein the cutting mechanism comprises two rollers for maintaining the first tape therebetween, one of the rollers is movable against the other roller to cut the first tape.

21. The tape application system of claim 17, wherein the cartridge comprises a roll balancer capable of maintaining a substantially constant pressure on the first tape residing in the cartridge.

* * * * *